US006046706A

United States Patent [19]

Vargas

[11] Patent Number: 6,046,706

[45] Date of Patent: Apr. 4, 2000

[54] ANTENNA MAST AND METHOD OF USING SAME

[76] Inventor: Robert A. Vargas, 3035 Victor Ave., Visalia, Calif. 93277

[21] Appl. No.: 08/879,433

[22] Filed: Jun. 20, 1997

[51] Int. Cl.[7] ..... H01Q 1/10

[52] U.S. Cl. ..... 343/883; 343/903; 343/901; 343/889; 343/883; 343/880; 521/118; 521/121

[58] Field of Search ..... 343/833, 903, 343/901, 889; 248/405

[56] References Cited

U.S. PATENT DOCUMENTS 4,785,309 11/1988 Gremillion ..... 343/883
5,218,375 6/1993 Hillman ..... 343/883
5,615,855 4/1997 Marue et al. ..... 248/405

*Primary Examiner*—Robert H. Kim
*Assistant Examiner*—Layla G. Lauchman
*Attorney, Agent, or Firm*—Higgs, Fletcher & Mack LLP; Bernard L. Kleinke

[57] ABSTRACT

An antenna mast and method of using it relate to a retractable mast having a retractable mast having a plurality of tubular telescoping sections to enable the mast to move between a fully retracted storage position and a fully extended use position. Each section is equipped with a thermoplastic bearing to facility rapid deployment. Pairs of diametrically opposed pulley mechanisms are mounted on opposite sides of each one of the sections, and the pairs of pulleys are angularly displaced from section to section for facilitating the structural stability of the deployed mast.

10 Claims, 6 Drawing Sheets

ANTENNA MAST AND METHOD OF USING SAME

TECHNICAL FIELD

The present invention relates in general to an antenna mast and a method of using it. More particularly, the present invention relates to a retractable tower antenna mast, which is driven between a retracted storage position and a fully extended deployed position, and which can be used for a variety of applications, including the mounting on top of a light-weight vehicle for mobile applications, such as broadcast microwave systems.

BACKGROUND ART

There have been a variety of different types and kinds of retractable tower antenna masts used for a variety of purposes. In this regard, the antenna mast is a mast having an antenna, such as a radio frequency antenna, mounted at the top end thereof. The mast can be retractable, wherein the mast can be retracted into a storage position in which the mast is relatively short in its overall height dimension. Alternatively, the retractable mast can be lengthened by causing it to move extensively upwardly into a fully extended or deployed use position where the overall height is many times larger than its retracted storage height dimension.

One example of a retractable tower antenna mast was one which could be driven between a storage height of approximately 30 feet and a fully deployed height of approximately 90 feet. Such a unit had three telescoping steel tubular sections. In its use position, the fully extended upright antenna mast was not perfectly erect and would tend to lean in one direction. Such a leaning attitude is not entirely satisfactory for many applications due to its inherent structural instability. Furthermore, such a large heavy unit would deploy slowly. For example, such a four section steel mast would deploy from a 30 foot nested position to a 90 foot deployed position, in about 15 minutes.

Thus, such a heavy and unwieldly antenna mast would not at all be satisfactory for other applications, such as for use on a vehicle for use in mobile communications, such as broadcast microwave systems used by television reporters relaying current news event reports to a broadcast station. For such an application, the antenna mast is mounted on a light-weight vehicle, such as a van. The mast must necessarily be relatively light in weight, and thus cannot be made of heavy materials such as steel. Also, the mast must be stored in a nested or a storage position in a compact configuration such as a height of no more than approximately eight feet. This is important because when the vehicle is traveling from place to place, the nested or stored antenna mast mounted on top of the vehicle must be able to pass under bridges or other overpass structures along the roadway.

Such light-weight mobile antenna masts have employed pneumatic actuators to deploy them. In this regard, an on-board air compressor unit is employed to move the mast between its storage and use positions. However, the pneumatic system was not at all satisfactory for many applications, since it operated quite slowly. In this regard, the air compressor required an undesirably long period of time to develop sufficient pressure to raise the antenna mast. Also, in many adverse climate conditions, such as cold weather conditions, the pneumatic system did not function at all satisfactorily. Furthermore, seals would wear at an undesirably fast rate. Additionally, the pneumatic systems release too slowly, and thus the mast would retract very slowly and thus required an unduly long waiting period.

Therefore, it would be highly desirable to have a new and improved antenna mast which could deploy very rapidly, such as in a time period of under one minute. Also, such a new and improved antenna mast should be structurally stable when disposed in its fully extended upright position. This is particularly important with light-weight masts which may be used in adverse climate conditions including high winds and snow and ice conditions.

DISCLOSURE OF INVENTION

It is a principal object of the present invention to provide a new and improved antenna mast and a method of using it, wherein the mast is structurally stable and deploys and retracts quickly.

Another object of the present invention is to provide such a new and improved antenna mast and method of using it, wherein the mast is light in weight and can be used for mobile vehicle applications.

Briefly, the above and further objects of the present invention may be realized by providing a light-weight retractable antenna mast, which deploys quickly and conveniently and is structurally sturdy manner when it is disposed in its fully deployed position. Such a new and improved antenna mast is sufficiently light in weight to be used atop a vehicle for mobile applications.

An antenna mast and method of using it relate to a retractable mast having a plurality of tubular telescoping sections to enable the mast to move between a fully retracted storage position and a fully extended use position. Each section is equipped with a thermoplastic bearing to facilitate rapid deployment. Pairs of diametrically opposed pulley mechanisms are mounted on opposite sides of the sections, and the pairs of pulleys are angularly displaced from section to section for facilitating the structural stability of the deployed mast.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 2:
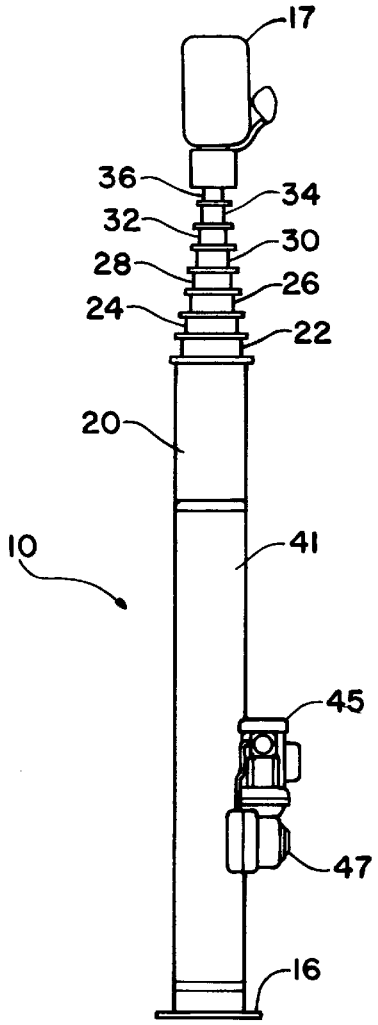
FIG. 2 is a diagramatical view of the mast of FIG. 1 illustrating the mast in a fully retracted storage position from a right side thereof.
Figure 1:
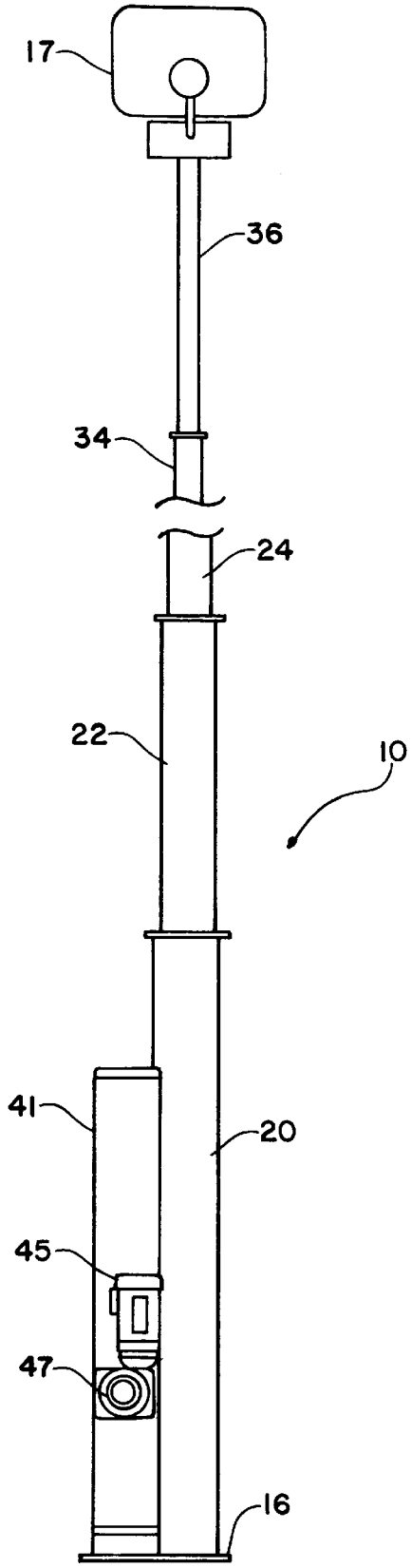
FIG. 1 is a cut-away diagramatical view of an antenna mast illustrating the mast in a fully extended deployed position from a front side thereof, which is constructed in accordance with the present invention.

Referring now to the drawings, and more particularly to FIGS. 1–2 thereof, there is shown a telescoping tubular antenna mast assembly 10, which is constructed in accordance with the present invention. The mast 10 is adapted for use with a vehicle (not shown) to extend and retract an antenna 17. One skilled in the art will realize, however, that the mast 10 can be used to extend or retract devices other than antennas, and can be secured to a support other than a vehicle.

The vertical height of the mast 10 is about 8 feet in a retracted, storage or nested position. In an extended, use, or deployed position, the mast 10 has a vertical height of about 42 feet. While the mast 10 is shown and described is preferred, different. Thus, the mast 10 provides an extended to retracted height ratio of about 5 to 1.

The mast 10 generally includes a plurality of tubular sections, wherein the sections nest within each other. In this regard, the mast 10 includes a base section 20 having a base plate 16 at one end thereof to facilitate securing the mast 10 to the vehicle. The base section 20 has an outside diameter of approximately eight inches. Intermediate sections 22, 24, 26, 28, 30, 32 and 34 have decreasing outside diameter dimensions to enable the intermediate sections 22, 24, 26, 28, 30, 32 and 34 to be received telescopingly within an adjacent member having a larger diameter. Similarly, a top or uppermost section 36 has an outside diameter smaller than the adjacent intermediate section 34 to enable the top section 36 to be received within the section 34.

As will be described hereinafter in greater detail, adjacent section members are coupled to one another to facilitate the substantially simultaneous extension of the sections from the adjacent sections as the mast 10 is extended, and to permit the substantially simultaneous retraction of the sections within adjacent sections when the mast 10 is retracted.

The mast 10 further includes a winch assembly housing 41 enclosing a winch assembly 43 (FIG. 9), a motor 45 for controlling the winch assembly 43 to extend or retract the mast 10, and a gear box 47 operatively coupling the motor 45 to the winch assembly 43.

Figure 3:
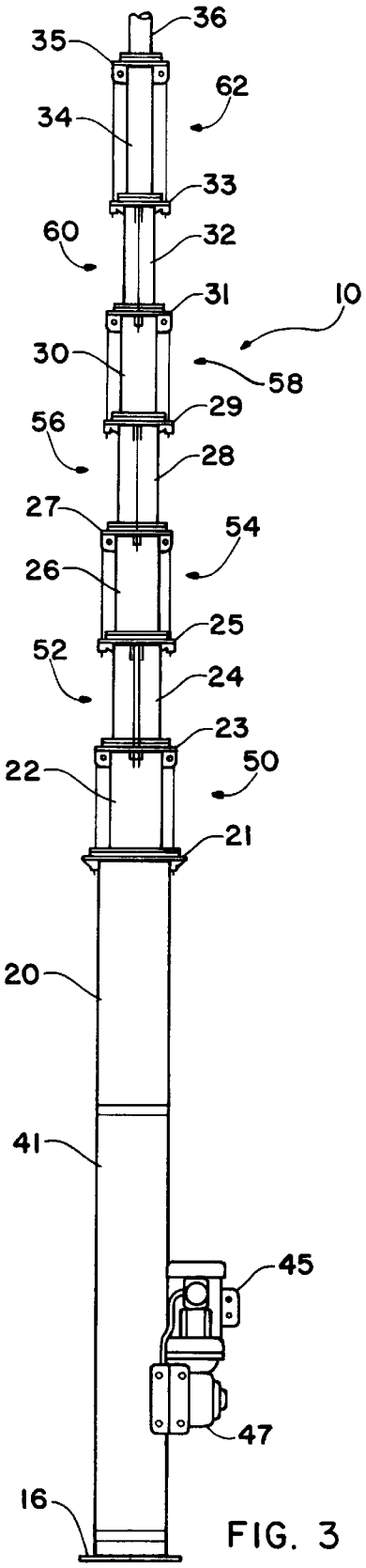
FIG. 3 is an elevation view of the mast of FIG. 1 illustrating the mast in a substantially extended position from the right side thereof.
Figure 4:
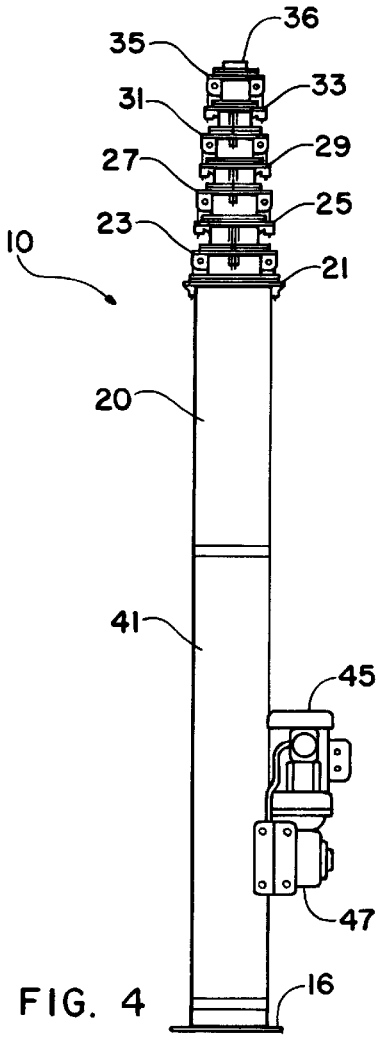
FIG. 4 is an elevation view of the mast of FIG. 1 illustrating the mast in a substantially retracted position from the right side thereof.

As best seen in FIGS. 3 and 4, the mast sections 20, 22, 24, 26, 28, 30, 32, 34 and 36 are coupled by a plurality of extension/retraction arrangements, including extension/retraction arrangements 50, 52, 54, 58, 60, and 62 (FIG. 3). In this regard, the intermediate section 22 has an outside diameter less than the outside diameter of the base section 20, and is received slidably therein. Similarly, the intermediate section 24 has an outside diameter less than the outside diameter of the immediate section 22. Thus, the intermediate section 24 is received slidably within the intermediate section 22, which is itself slidably received within the base section 20. The remaining sections 26, 28, 30, 32, 34 and 36 are also slidably received within adjacent section in a similar manner as described for base section 20 and intermediate sections 22 and 24. Stated another way, each one of the intermediate sections 22, 24, 26, 28, 30, 32 and 34 is received within a next outermost section, and receives a next innermost section therein.

The extension/retraction arrangements 50, 52, 54, 56, 58, 60, and 62 are coupled to external flange assemblies 21, 23, 25, 27, 29, 31, 33 and 35 to facilitate the extending and retracting of the mast 10, as will be described hereinafter in greater detail. The extension/retraction arrangements 50, 52, 54, 56, 58, 60, and 62 link spaced apart sections, such as base section 20 and intermediate section 24, intermediate section 22 and intermediate section 26, intermediate section 24 and intermediate 28, intermediate section 26 and intermediate section 30, intermediate section 28 and intermediate section 32, intermediate section 30 and intermediate section 34, and intermediate section 32 and top section 36, to cause the mast 10 to extend or retract as the intermediate sections 22, 24, 26, 28, 30, 32 and 34 are extended or retracted.

As best seen in FIG. 4, the external flange assemblies 21, 23, 25, 27, 29, 31, 33 and 35 are spaced apart from one another by the extension/retraction assemblies 50, 52, 54, 58, 60 and 62 when the mast 10 is in a fully retracted position.

The winch assembly 43 (FIG. 9) couples the base section 20 to the intermediate section 22 to facilitate extending the intermediate section 22 relative to the base section 20, or retracting the top section 36 and the lower intermediate section during a retraction operation. By extending or retracting the intermediate section 22 relative to the base section 20 by the winch assembly 43, the extension or retraction of remaining sections 24, 26, 28, 30, 32, 34 and 36 relative to the adjacent section is controlled.

In operation, the mast 10 is maintained in the fully retracted or storage position (FIG. 4) when not in use. For example, when used on a vehicle, the mast 10 is maintained in the fully retracted position to permit the mast 10 and the antenna to avoid contact with roadside obstacles while the vehicle is in motion to substantially prevent damaging the antenna 17 or mast 10.

Upon arrival of the vehicle at a desired broadcast or receiving location, the motor 45 is activated to operate the winch assembly 43 via the gear box 47. The winch assembly 43 enables the intermediate section 22 to be extended upwardly relative to the base section 20, thereby increasing the distance between the spaced apart external flange assemblies 21 and 23. The extension/retraction arrangement 50 is responsive to the intermediate section 22 extending upwardly from the base section 20 to simultaneously cause the intermediate section 24 to extend upwardly from the intermediate section 22. The remaining intermediate sections 26, 28, 30, 32 and 34, and the top section 36, are also simultaneously extended from the adjacent section by the extension/retraction arrangements 52, 54, 56, 60 and 62 in a similar manner. In this way, the entire mast 10 is extended to the fully extended use position by controlling the extension of the intermediate section 22 relative to the base section 20, wherein the remaining sections 24, 26, 28, 30, 32, 34 and 36 are responsive to the movement of the section 22 relative to the section 20 to telescopically extend the mast 10 to its fully extended position. The mast 10 is maintained in the fully extended position until it is desired to retract the mast 10.

When desired, the mast 10 is retracted by activating the motor 45 in a reverse direction to operate the winch assembly 43 via the gear box 47 to retract the top section 36 relative to the base section 20. A force is applied to section 36 to retract it within the section 20, the extension/retraction assembly 50 permits the intermediate section 24 to be retracted within the section 22. Similarly, the extension/retraction assemblies 52, 54, 56, 60 and 62 enable the sections 26, 28, 30, 32, 34 and 36 to be retracted within the adjacent or next outermost section wherein the mast 10 is telescopically retracted to the fully retracted position.

Figure 5:
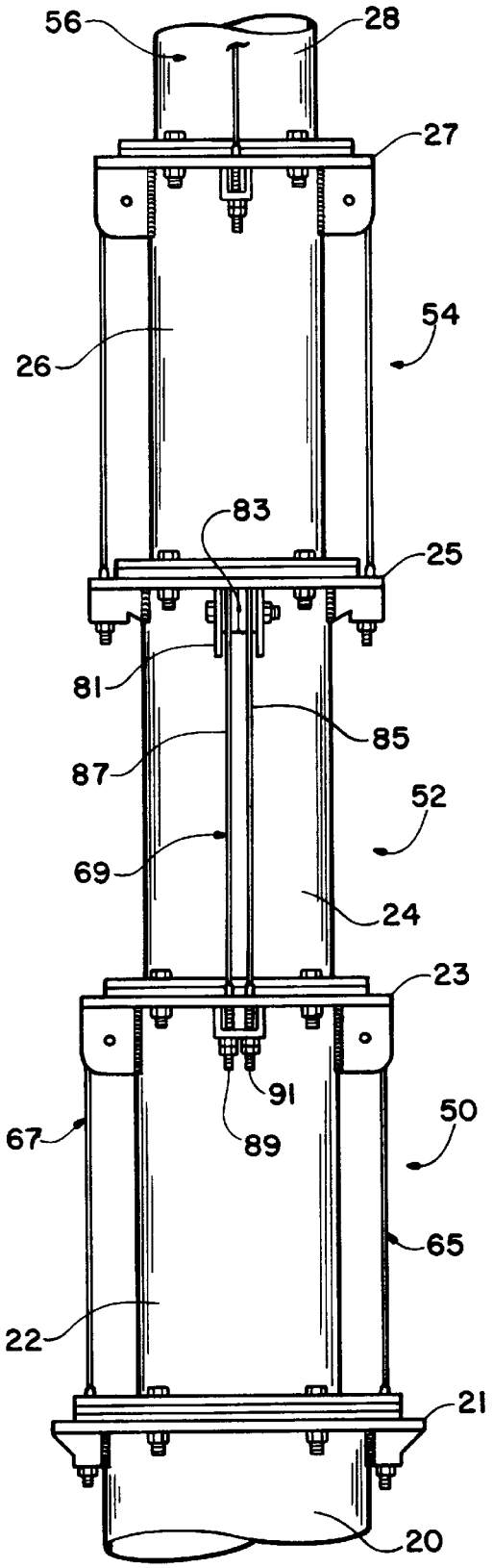
FIG. 5 is an enlarged cut-away elevation view of the mast of FIG. 1.

Considering now the extension/retraction arrangements 50, 52, 54, 56, 58, 60 and 62 in greater detail with reference to the FIG. 5, the extension/retraction arrangements 50, 52, 54, 56, 58, 60 and 62 each include a pair of diametrically opposed pulley mechanisms such as the oppositely disposed pulley mechanism 65 and 67 of extension/retraction arrangement 50. The diametrically opposed pulley mechanisms, such as the mechanisms 65 and 67, permit the mast 10 to be raised evenly, and provide additional security against accidental retraction of the extended mast 10. In this regard, the use of two pulley mechanisms, such as the mechanisms 65 and 67, provides redundancy, wherein damage to one of the pair of mechanisms 65 and 67 would not render the mast 10 inoperative as the remaining mechanisms would still enable the mast 10 to be extended or retracted.

Figure 6:
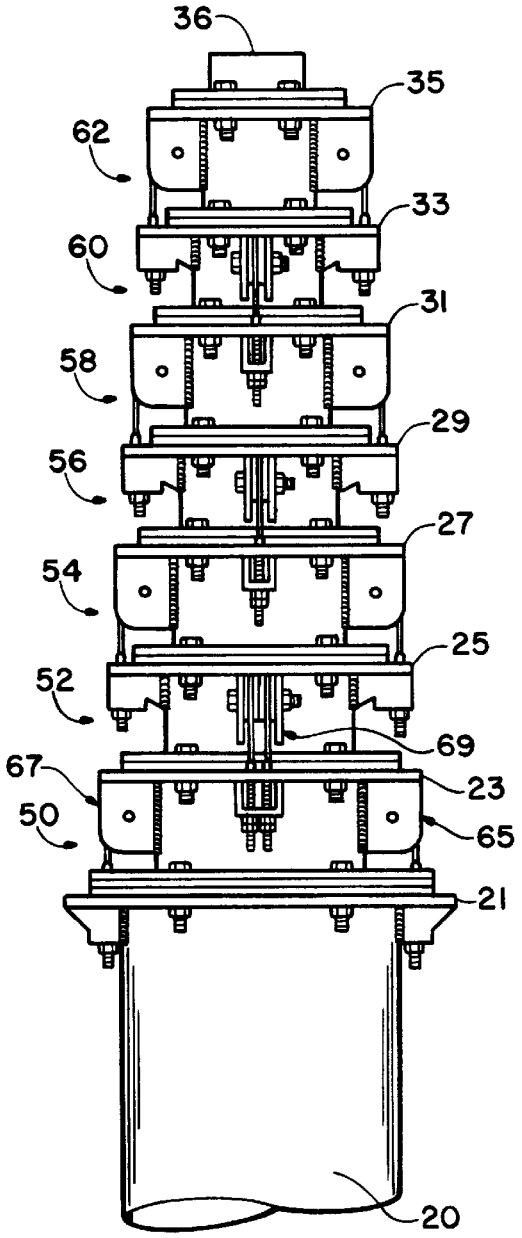
FIG. 6 is an enlarged cut-away elevation view of the mast of FIG. 1 in a substantially retracted position.

To raise evenly the mast 10, the pulley mechanisms for each section are angularly displaced 90° from the pulley mechanisms for the next innermost section and for the net outermost section. As best seen in FIGS. 5 and 6, the pulley mechanisms 65 and 67 of extension/retraction arrangement 50 are shown in a plane substantially parallel to the plane of the drawings, while the pulley mechanisms 69 and oppositely disposed and paired pulley mechanisms (not shown) of the extension/retraction arrangement 52 are in a plane substantially perpendicular to the plane of the drawings. This same pattern of angularly displacing the extension/retraction arrangements is continued for the remaining arrangements 54, 56, 58, 60 and 62.

Figure 7:
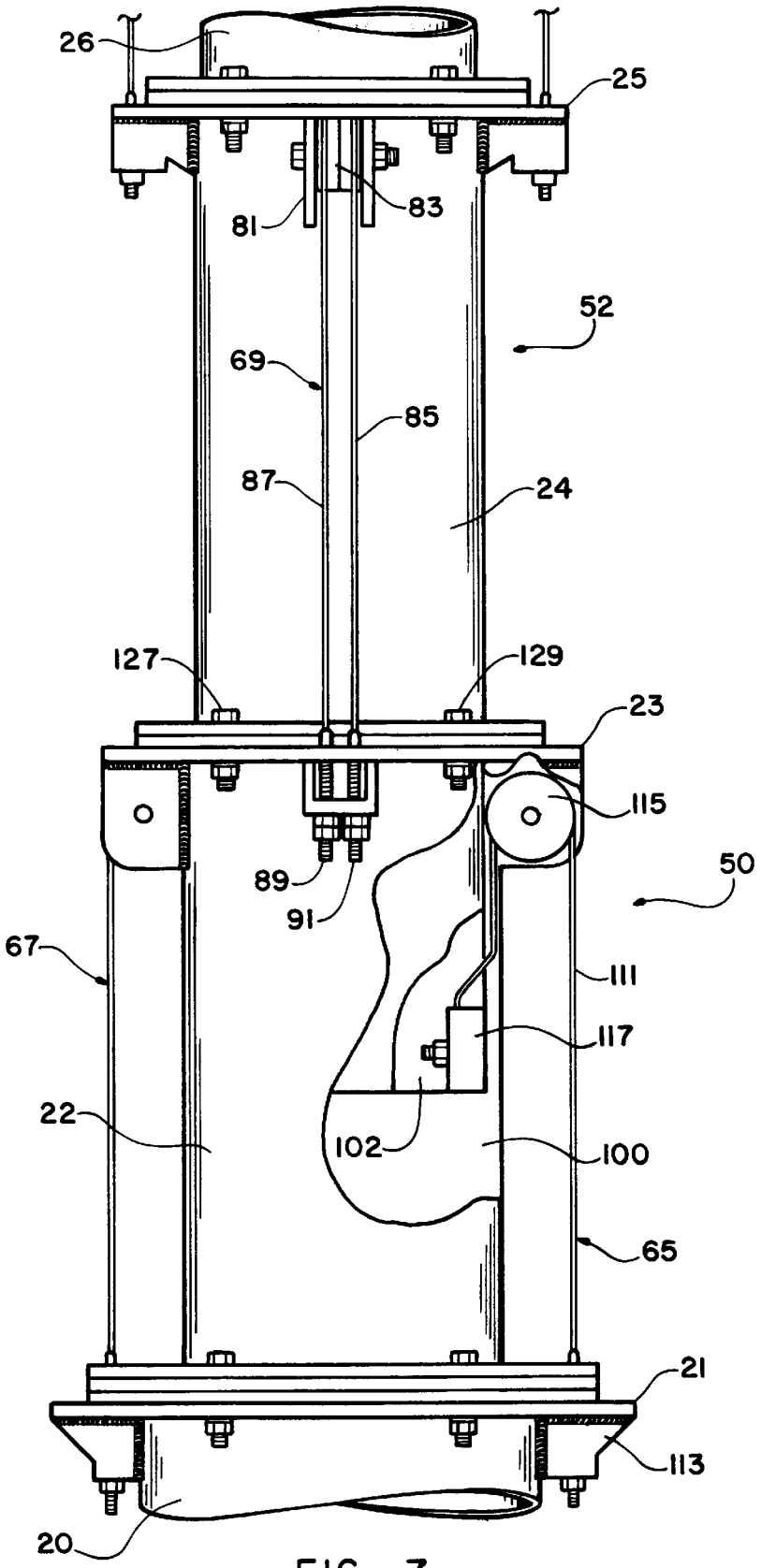
FIG. 7 is an enlarged cut-away view of the mast of FIG. 1 illustrating an extension/retraction/arrangement thereof.

As each of the pulley mechanisms are substantially similar, only pulley mechanism 69 will be described hereinafter in greater detail with reference to FIG. 7.

The mechanism 69, together with the diametrically opposed mechanism (not shown), cooperate with the next outermost section 22 and the next innermost section 26 of section 24 to help extend or retract the mast.

The pulley mechanisms 69 includes a pair of cables 85 and 87 secured at one end to the external flange assembly 23 by securing devices 89 and 91. The cables 85 and 87 extend upwardly from the assembly 23 and are engaged by a double pulley member 83 secured by a pulley housing 81 to the external flange assembly 23. The other ends (not shown) of the cables 85 and 87 are secured to a lower portion (not shown) of the section 26 within the section 24.

As shown and described herein, the extension/retraction arrangements 50 and 52 utilize pulley mechanisms such as mechanisms 65, 67 and 69 having pairs of cables, such as cables 85 and 87, to provide sufficient support for the weight of the sections 26, 28, 30, 32, 34 and 36. The remaining extension/retraction arrangements 54, 56, 58, 60 and 62 utilize pulley mechanisms having only a single cable as the weight to be supported is reduced for the upper sections.

Considering now the coupling of the extension/retraction arrangements 50, 52, 54, 56, 58, 60 and 62 to the sections 24, 26, 28, 30, 32, 34 and 36 in greater detail, only the coupling of the arrangement 52 will be considered hereinafter in greater detail. The pulley mechanism 65 of the arrangement 50 includes a cable 111 secured at one end to the external flange assembly 21 by securing arrangement 113. The cable 111 extends upwardly from the assembly 21 to engage a pulley 115. The pulley 115 extends partially through an opening 119 (FIG. 8) to enable the cable 111 to extend within the interior 100 of the section 22. The pulley 115 redirects the cable 111 downwardly through a gap between the section 24 and the section 22. An opening 117 (FIG. 8) enables the cable 111 to extend into the interior 102 of the section 24, wherein the other end of the cable 111 is secured to the section 24 by securing arrangement 117.

The position of the section 24 within the section 22 is controlled by the displacement of the pulley 115 from the assembly 21. In this regard, extending the section 22 out of the section 20 displaces the pulley 115 above the assembly 21. Consequently, the pulley 115 decreases the length of the cable 111 between the pulley 115 and securing arrangement 117 to urge the section 24 out of the section 22. Conversely, retracting the section 22 into the section 20 moves the pulley 115 toward the assembly 21, wherein the length of cable 111 between the pulley 115 and the securing arrangement 117 is increased to enable the section 24 to be retracted into the interior 100 of the section 22.

Figure 8:
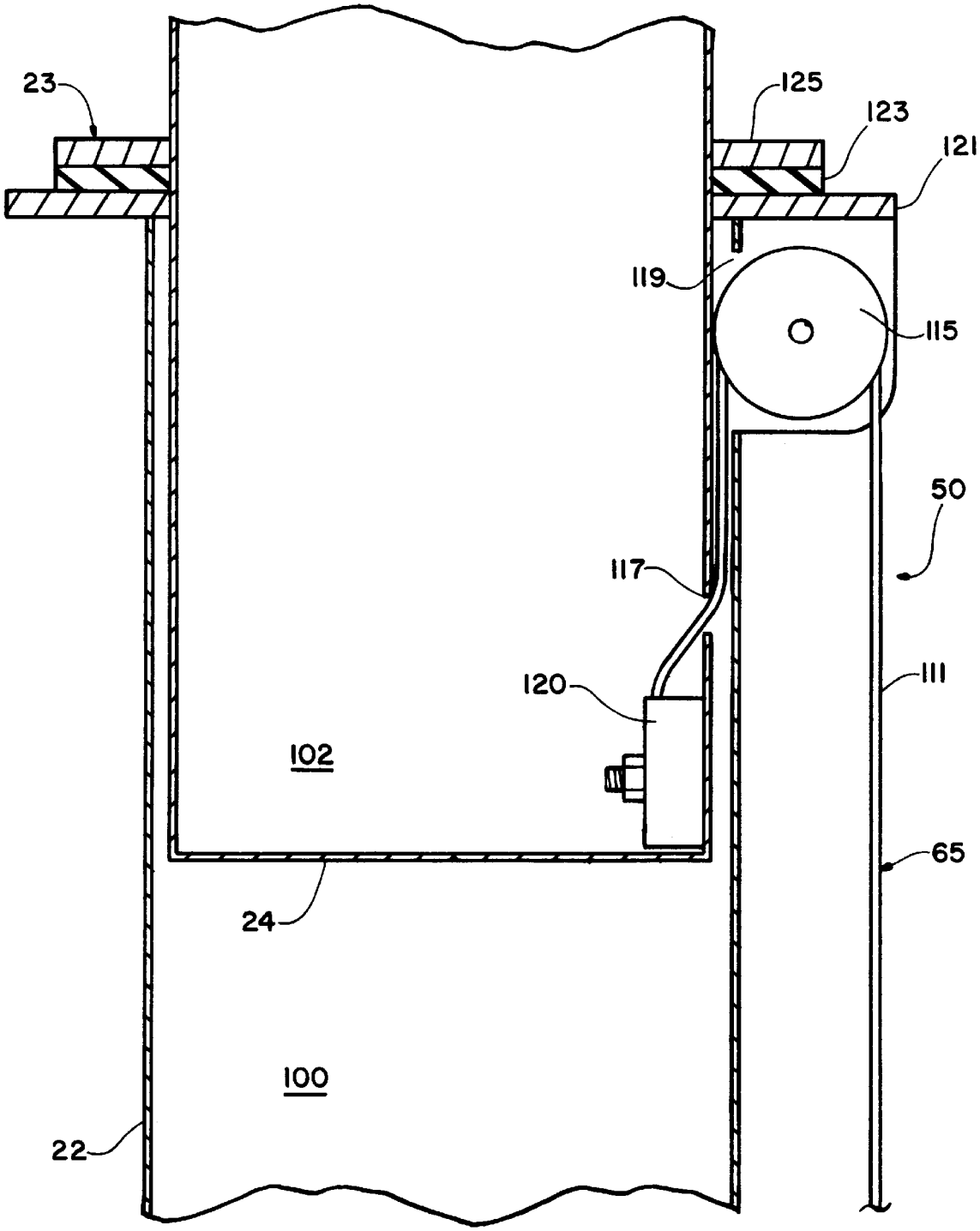
FIG. 8 is an enlarged sectional view of the mast of FIG. 1 illustrating a bearing assembly thereof.

Considering now the assemblies 23, 25, 27, 29, 31, 33 and 35, only assembly 23 will be considered hereinafter in greater detail with reference to FIG. 8 as the assemblies 23, 25, 27, 29, 31, 33 and 35 are substantially similar. The assembly 23 includes an annular flange 121 secured to an upper portion of the section 22, and extending outwardly therefrom to facilitate securing the arrangement 50 thereto. The arrangement 23 further includes an annular bearing member 123 disposed between an upper annular ring 125 and the flange member 121 to substantially reduce the frictional engagement of the section 24 with the assembly 23 for permitting the mast 10 to extend and retract in a relatively smooth and quick manner. The upper ring 125 and the bearing ring 123 are secured to the flange 121 in an overlying relationship by a set of spaced apart fastening devices, such as the fastening devices 127 and 129 (FIG. 7) extending through the upper ring 125, the bearing ring 123 and flange 121.

The bearing ring 123 includes a notch for receiving slidably a vertical spline 106 connected to the outside of the section 24. The notch and spline 106 enable the rotation of the section 24 relative to the section 22 to be controlled while enabling the section 24 to be extended and retracted relative to the section 22. Preferably, the bearing ring 123 is constructed from a thermoplastic material, such as a Delrin thermoplastic material.

The flange 121 and upper ring 125 are constructed from a durable material such as aluminum. The central openings of the flange 121, the bearing member 123 and the upper ring 125 are sufficiently large to receive the section 24 slidably therein.

The sections 20, 22, 24, 26, 28, 30, 32, 34 and 36 of the mast 10 are preferably constructed from a durable material. In particular, the use of aluminum is desirable as it provides strength while reducing the overall weight of the mast 10.

Figure 9:
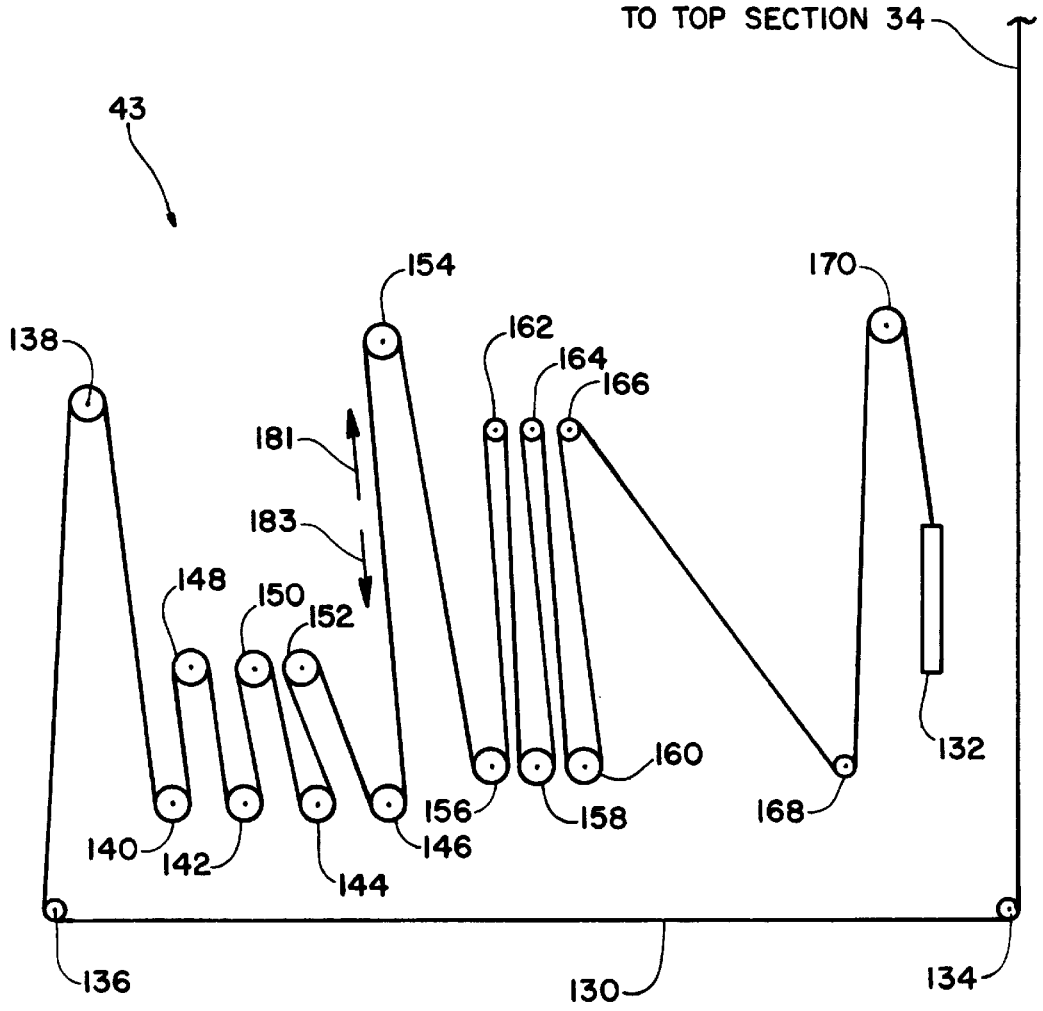
FIG. 9 is a diagramatic view of a winch assembly for the mast of FIG. 1.

Considering now the winch assembly 43 with reference to FIG. 9, the winch assembly 43 includes a cable 130 connected between the top section 34 (FIG. 1) and an adjustable turn buckle 134 disposed on the outside of the base section 20. The cable 130 extends downwardly through the sections 20, 22, 24, 26, 28, 30 and 32 of the mast 10 to a pulley 134. The pulley 134 redirects the cable out of the mast 10 and into the winch assembly housing 41. A pulley 136 redirects the cable 130 to a moveable idler pulley 138. The cable 130 then passes over a series of pulleys within the housing 41, including pulleys 140, 142, 144, 146, 148, 150 and 152. The pulleys 140, 142, 144 and 146 are coupled to the motor 45 (FIG. 1) via the gear box 47 (FIG. 1) to control the movement of the cable 130 in one of two directions indicated by arrows 181 and 183.

The cable 130 extends from the pulley 146 to a pulley 154 which redirects the cable 130 into section 22. A set of pulleys including pulleys 156, 158, 160 and 168 are fixed to the base section 20, and cooperate with a group of pulleys including 162, 164 and 166 secured to the base section 20 for cooperating with the cable 130 to facilitate controlling the extension and retraction of the section 22 relative to the section 20.

The cable 130 extends from the pulley 168 to a pulley 170, wherein the cable 130 is redirected to extend out of the base section 20 where the cable 130 is secured by the turn buckle 132.

The external flange assembly 21 is similar to the assemblies 23, 25, 27, 29, 31, 33 and 35, except that it includes two upper annular rings to secure a bearing annular ring between the upper rings and an annular flange.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An antenna mast, comprising;

a plurality of telescoping generally tubular sections including a top section, at least one intermediate section, and a base section;

each section having an external annular flange at the upper end thereof and having an annular bearing for engaging slidably the next innermost section for facilitating rapid deployment and retraction of the mast;

each one of said bearings being mounted on its annular flange and having a central opening therein being approximately the same size as said next innermost section for receiving it slidably;

each one of said bearings being composed of thermoplastic material;

pulley means for causing said sections to move between a retracted storage position and a fully extended deployed use position;

said pulley means also causing said sections to move between said fully extended deployed use position and the retracted storage position;

said pulley means further comprising an extension/retraction arrangement coupling adjacent sections so that the at least one intermediate section is coupled to another non-base section;

motive means for driving said pulley means thereby providing an extension force or a retraction force; and wherein said motive means causes two or more sections to extend substantially simultaneously when the extension force is applied to said extension/retraction arrangement and said motive means causes two or more sections to retract substantially simultaneously when the retraction force is applied to said extension/retraction arrangement.

2. An antenna mast, comprising;

a plurality of telescoping generally tubular sections;

each section having an external annular flange at the upper end thereof and having an annular bearing for engaging slidably the next innermost section for facilitating rapid deployment and retraction of the mast;

each one of said bearings being mounted on its annular flange and having a central opening therein being approximately the same size as said next innermost section for receiving it slidably;

each one of said bearings being composed of thermoplastic material;

pulley means for causing said sections to move between a retracted storage position and a fully extended deployed use position;

motive means for driving said pulley means; and a plurality of axially extending splines disposed on the outer surfaces of the upper sections, said bearings each including a spline receiving opening slidably therewithin to resist relative rotation of the sections.

3. An antenna mast, comprising;

a plurality of telescoping generally tubular sections;

each section having an external annular flange at the upper end thereof and having an annular bearing for engaging slidably the next innermost section for facilitating rapid deployment and retraction of the mast;

each one of said bearings being mounted on its annular flange and having a central opening therein being approximately the same size as said next innermost section for receiving it slidably;

each one of said bearings being composed of thermoplastic material;

pulley means for causing said sections to move between a retracted storage position and a fully extended deployed use position;

motive means for driving said pulley means; and wherein said annual bearings each being disposed in overlying relationship on its external annular flange, further including a plurality of upper external annular flanges, each being disposed in overlying relationship on its corresponding annual bearing to be interposed between the first-mentioned and its upper flange.

4. An antenna mast according to claim 1, wherein each bearing is composed of Delrin material.

5. An antenna mast according to claim 1, further including an antenna mounted on top of the uppermost section.

6. An antenna mast, comprising:

a plurality of telescoping generally tubular sections;

pulley means for causing said sections to move between a retracted storage position and a fully extended deployed storage position;

motive means for driving said pulley means;

said pulley means including pairs of pulley mechanisms mounted on opposite sides of the upper sections for raising and lowering the next innermost section relative thereto during movement of the mast between its storage and use positions to help stabilize structurally the mast when disposed in its use position; and said pairs of pulley mechanisms being angularly alternately displaced from one section to the next to help maintain the deployed mast in an erect upright manner.

7. An antenna mast according to claim 6, wherein each one of said pairs of pulley mechanisms includes a pulley mechanism having a pulley mount on the upper portion of a section and having a cable fixed at one of its ends to the next outermost section and fixed at is opposite end to the next innermost position.

8. An antenna mast according to claim 7, further including an antenna mounted to the topmost section.

9. A method of using an antenna mast according to claim 6, moving said sections between said storage and use positions.

10. A method for extending an antenna mast, the antenna mast comprising a base section, a plurality of telescoping sections, and a pulley means, the pulley means further including an extraction/retraction arrangement for coupling at least two telescoping sections, the method comprising:

positioning the antenna mast in a fully retracted position;

activating a motive means that is coupled to the pulley means, the motive means thereby applying an extending motive force to the extraction/retraction arrangement;

extracting responsive to the extending motive force the at least two telescoping sections, the extraction of the at least two telescoping sections being substantially simultaneous;

deactivating the motive means when the antenna mast is fully extended;

activating the motive means to apply a retraction force to the extraction/retraction arrangement;

retracting responsive to the retracting force the at least two telescoping sections, the retraction of the at least two telescoping sections being substantially simultaneous; and deactivating the motive means when the mast is fully retracted.

* * * * *